US006325006B1

(12) United States Patent
Park

(10) Patent No.: US 6,325,006 B1
(45) Date of Patent: Dec. 4, 2001

(54) THREAD FEEDING APPARATUS FOR AN AUTOMATIC EMBROIDERING MACHINE

(76) Inventor: Ham-Kyu Park, 103-406, Hyundai APT Kaekum 3-dong, Pusanjin-Ku 614-113 Pusan (KR)

( * ) Notice: Subject to any disclaimer, the term of this patent is extended or adjusted under 35 U.S.C. 154(b) by 0 days.

(21) Appl. No.: 09/766,576

(22) Filed: Jan. 23, 2001

Related U.S. Application Data

(63) Continuation-in-part of application No. 09/622,457, filed on Aug. 17, 2000.

(51) Int. Cl.[7] ..... D05C 11/08; D05B 49/00; D05B 47/00

(52) U.S. Cl. ..... 112/80.7; 112/241; 112/302

(58) Field of Search ..... 112/80.7, 80.73, 112/80.07, 167, 241, 302

(56) References Cited

U.S. PATENT DOCUMENTS 3,595,185 * 7/1971 Shorrock et al. ..... 112/80.7 X
4,393,793 * 7/1983 Beasley ..... 112/80.7
5,269,244 * 12/1993 Cataletto ..... 112/302
5,682,830 * 11/1997 Katou et al. ..... 112/302
6,213,036 * 4/2001 Slattery ..... 112/80.73

* cited by examiner

*Primary Examiner*—Ismael Izaguirre
(74) *Attorney, Agent, or Firm*—Birch, Stewart, Kolasch & Birch, LLP

(57) ABSTRACT

Disclosed is a thread feeding apparatus for an automatic embroidering machine. The apparatus is comprised of a head stem having a needle-working unit; a thread supplying unit supplying a colored thread selected among a plurality of threads; a guide pipe assembly provided at said head stem, having a first guide pipe receiving the thread from said thread supplying unit, and a second guide pipe having an upper end spaced axially from said first guide pipe and a lower end adjacent to said needle-working unit; and a thread taking-up unit having a take-up lever moving up and down across a thread transferring path, and a take-up bar coupled with the take-up lever in a transverse direction relative to movement of the take-up bar, moving reciprocally through a space between said first and second guide pipes according to the movement of said take-up lever, to allow said thread to be strained or loosened. With this configuration, in a single structure of the head stem, a supplying path of the thread is prevented from being curved, to thereby efficiently feed the thread.

17 Claims, 16 Drawing Sheets

THREAD FEEDING APPARATUS FOR AN AUTOMATIC EMBROIDERING MACHINE

This application is a continuation-in-part of application No. 09/622,457 filed Aug. 17, 2000.

FIELD OF THE INVENTION

The present invention relates in general to automatic embroidering or needle-working machines, and more particularly, to a thread feeding apparatus for use in an automatic embroidering machine.

Generally, an automatic embroidering machine serves to automatically decorate clothes, shoes, or labels thereof with a variety of colored threads according to a predetermined program, to make embroidery for patterns, signs or marks, etc. Considering this, the automatic embroidering machine can be referred to as an automatic sewing machine.

In order to selectively use a variety of different colored threads, this kind of embroidering machine is comprised of a thread supplying unit for supplying a variety of colored threads, and a multiplicity of head stems corresponding to multiple threads supplied from the thread supplying unit. Because the machine has the multiple head stems, it has been referred to as a multi-head automatic embroidering machine. Each head stem of the embroidering machine is comprised of a needle for making embroidery by moving vertically, a presser foot for pressing a web on which embroidery is made, according to an operation of needlework, a thread taking-up unit for straining and loosening the thread passing through the eye of the needle, according to an upward and downward movement thereof.

However, the conventional multi-head automatic embroidering machine requires head stems as many as the number of threads in use. Further, each head stem has to be equipped with a needle, a presser foot, a thread taking-up unit and the respective driving means therefor, for which the head stem becomes very complicated in structure. Additionally, in order to replace the using thread with a thread different in color, the new thread must pass through the thread taking-up unit and the eye of the needle by hand, thereby making it inconvenient to replace a thread and also consuming a lot of time for replacement.

An automatic embroidering machine to solve this problem was disclosed in the Germany Laid-Open Print (offenlegungsschrift) under the number DE 196 24 344. The disclosed machine is comprised of a single head stem including a needle, a presser feet and a thread taking-up unit, and a thread supplying unit for selectively supplying threads of a plurality of colors to the head steam. The thread supplied by the thread supplying unit is drawn by a suction nozzle and transferred to the needle through a guide pipe.

However, the guide pipe for guiding the thread into he needle forms a curved path comprised of a pair of vertical sections and a horizontal section between the air of vertical sections. The curved path does not allow the thread to be smoothly transferred, thereby making it difficult to reach the needle.

On the horizontal section is formed a space through which the thread taking-up unit is allowed to pass in a transverse direction relative to the thread supplying direction, and therefore, the thread is highly likely to fall out of the needle when it passes through the space on the horizontal section.

SUMMARY OF THE INVENTION

The present invention has been made keeping in mind the above-described shortcomings, and an object of the present invention is to provide an improved thread feeding apparatus for an automatic embroidering machine, having a single head stem simplified in structure, wherein a supplying path of the thread is prevented from being curved, to thereby efficiently feed the thread.

Another object of the present invention is to provide a thread feeding apparatus for an automatic embroidering machine wherein a space formed on a thread supplying path may be removed as necessary, so as to prevent the supplied thread from being falling out of a needle.

These and other objects of the present invention ay be achieved by providing a thread feeding apparatus for an automatic embroidering machine, comprising a head stem having a needle-working unit; a thread supplying unit supplying a colored thread selected among a plurality of threads; a guide pipe assembly provided at the head stem, having a first guide pipe receiving the thread from the thread supplying unit and a second guide pipe having an upper end spaced axially from the first guide pipe and a lower end adjacent to the needle-working unit; and a thread taking-up unit having a take-up lever moving up and down across a thread transferring path, and a take-up bar coupled with the take-up lever in a transverse direction relative to movement of the take-up bar, moving reciprocally through a space between the first and second guide pipes according to the movement of the take-up lever, to allow the thread to be strained or loosened.

The thread supplying unit comprises a plurality of thread passages arranged in parallel above the head steam, horizontally relative to an axial direction of the first guide pipe, within which the end parts of the threads are respectively positioned; a tension adjusting unit adjusting a tension status of the threads; and a thread transfer nozzle transferring the end parts of the threads through the first and second guide pipes by blowing air into to thread passages.

The apparatus according to the present invention further comprises a main frame supporting the head stem; a movable frame installed to the main frame to support the thread supplying unit, being slidable above the main frame so that one thread passage among the thread passages aligns with the first guide pipe; and a sliding driver for sliding the movable frame relative to the main frame.

The thread supplying unit has a plurality of air holes penetrated thereinto, inclining downward toward the thread passages from outside; and wherein the thread transfer nozzle is coupled to an upper part of the head steam, blowing air into the air holes, through which the air is supplied into one thread passage selected by the movement of the movable frame.

The guide pipe assembly comprises an auxiliary guide pipe coaxially installed to the first or second thread guide pipes; and an auxiliary guide pipe driver closing and opening the space between the first and second thread guide pipes by elevating or moving said auxiliary guide pipe transversely relative to the axial direction.

The guide pipe assembly comprises a guide elevating driver closing and opening the space between the first and second guide pipes by elevating the first or second guide pipes.

Thread taking-up unit comprises a pair of the take-up levers arranged such that the first guide pipe is placed therebetween; and the take-up bar connecting free ends of the pair of take-up levers.

Preferably, the apparatus further comprises an auxiliary take-up unit including a thread suspension ring elevatably installed coaxially relative to the first guide pipe; and a ring driver elevating the thread suspension ring, to have the thread strained below the take-up bar.

These and other objects of the present invention may also be achieved by providing a thread feeding apparatus for an automatic embroidering machine comprising a head stem having a needle-working unit; a thread supplying unit supplying one thread selected among a plurality of threads; a guide pipe assembly provided to the head stem, having a thread guide pipe receiving the thread from the thread supplying unit and having a lower end adjacent to the needle-working unit, and a guide pipe driver elevating the guide pipe so that a predetermined space is formed between the thread passage and the guide pipe; a thread taking-up unit having a take-up lever moving up and down across a thread transferring path, and a take-up bar coupled with the take-up lever in a transverse direction relative to movement of the take-up bar, moving reciprocally through space between the first and second guide pipes according to the movement of the take-up lever, to allow the thread to be strained or loosened.

The thread supplying unit comprises a plurality of thread passages arranged in parallel above said head steam, horizontally relative to an axial direction of said guide pipe, within which the end parts of said threads are respectively positioned; a tension adjusting unit adjusting a tension status of said threads and releasing them; and a thread transfer nozzle transferring said end parts of the threads through said guide pipe by blowing air into said thread passages.

The apparatus according to the present invention further comprises a main frame supporting the head stem; a movable frame installed to the main frame to support the thread supplying unit, being slidable above the main frame so that one thread passage among the thread passages aligns with the first guide pipe; and a sliding driver for sliding the movable frame relative to the main frame.

The thread supplying unit has a plurality of air holes penetrated thereinto, inclining downward toward the thread passages from outside; and wherein the thread transfer nozzle is coupled to an upper part of the head steam, blowing air into the air holes, through which the air is supplied into one thread passage selected by the movement of said movable frame.

The guide pipe comprises a first guide pipe coupled to the head stem, having an upper end part isolated from the thread passages, and an auxiliary guide pipe installed coaxially over the first guide pipe; and wherein said guide pipe driver closes and opens said space between the thread passages and the first guide pipe by elevating said auxiliary guide pipe.

The thread taking-up unit comprises a pair of said take-up levers a-ranged such that said first guide pipe is placed therebetween; and said take-up bar connecting free ends of the pair of take-up levers.

The apparatus further comprises an auxiliary take-up unit including a thread suspension ring elevatably installed coaxially relative to said first guide pipe; and a ring driver elevating said thread suspension ring, to have said thread strained below said take-up bar.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENTS

Figure 1:
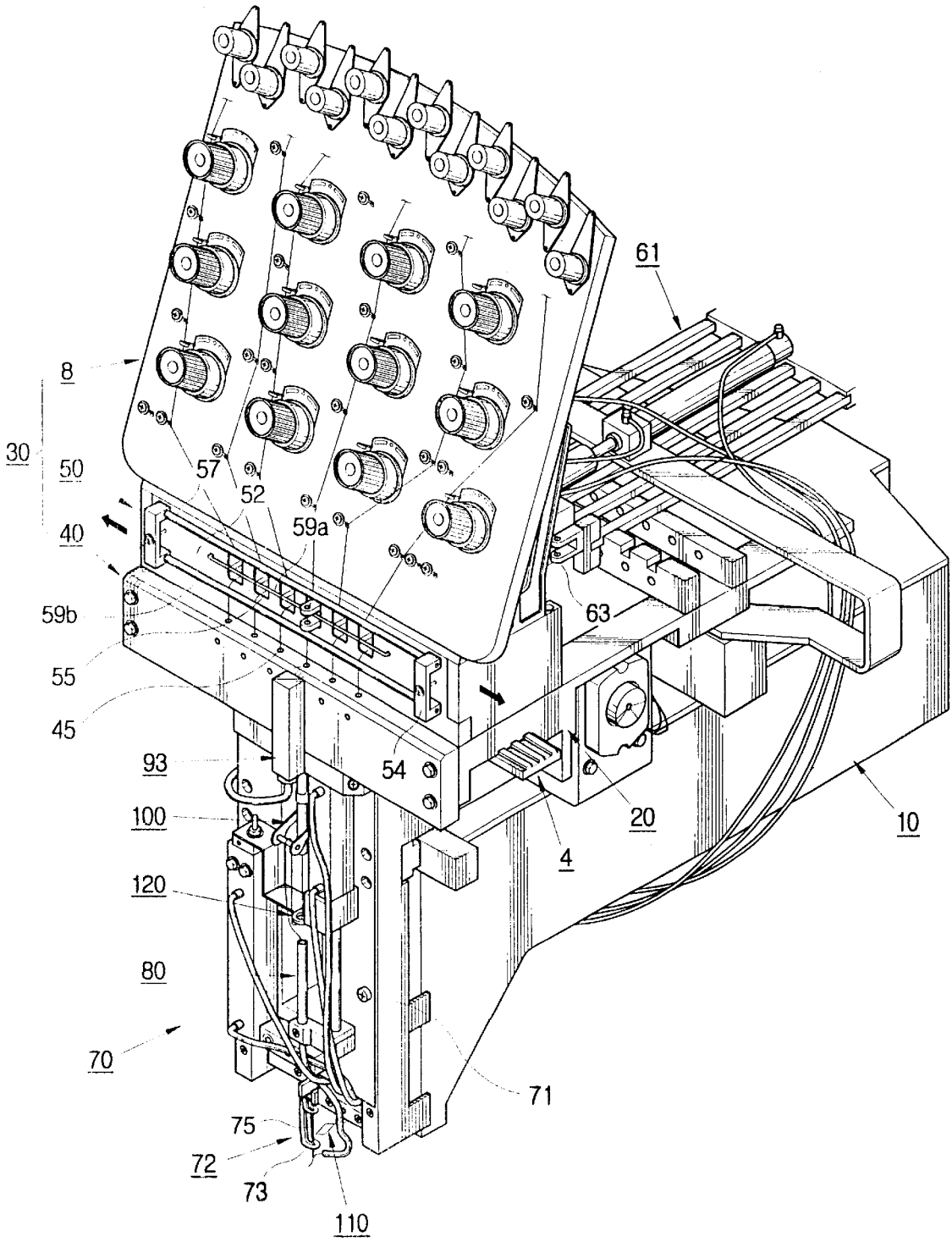
FIG. 1 is a perspective view of a thread feeding apparatus for an automatic embroidering machine according to a first embodiment of the present invention.
Figure 2:
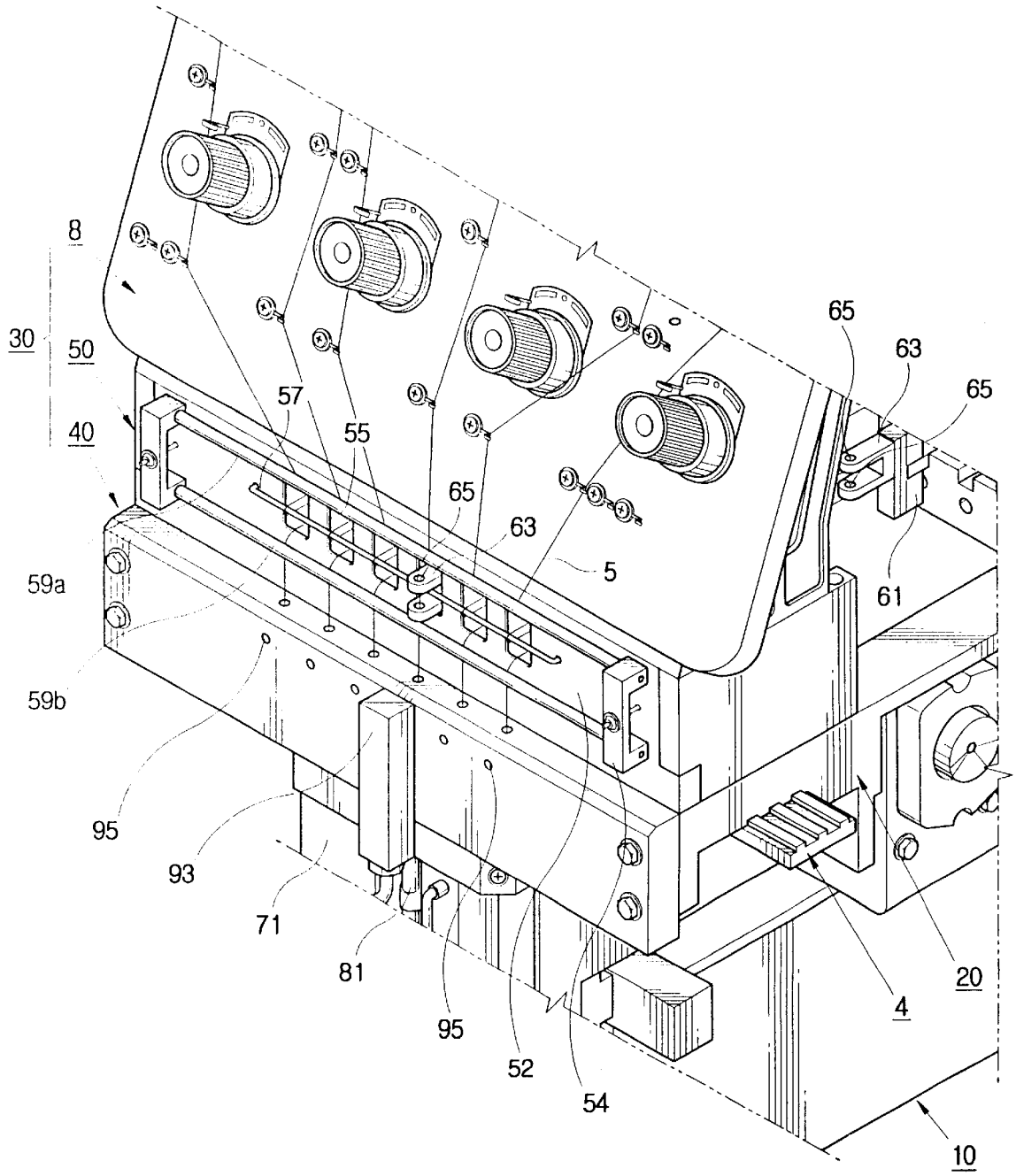
FIG. 2 is an enlarged perspective view partially showing a thread supplying unit of FIG. 1.
Figure 3:
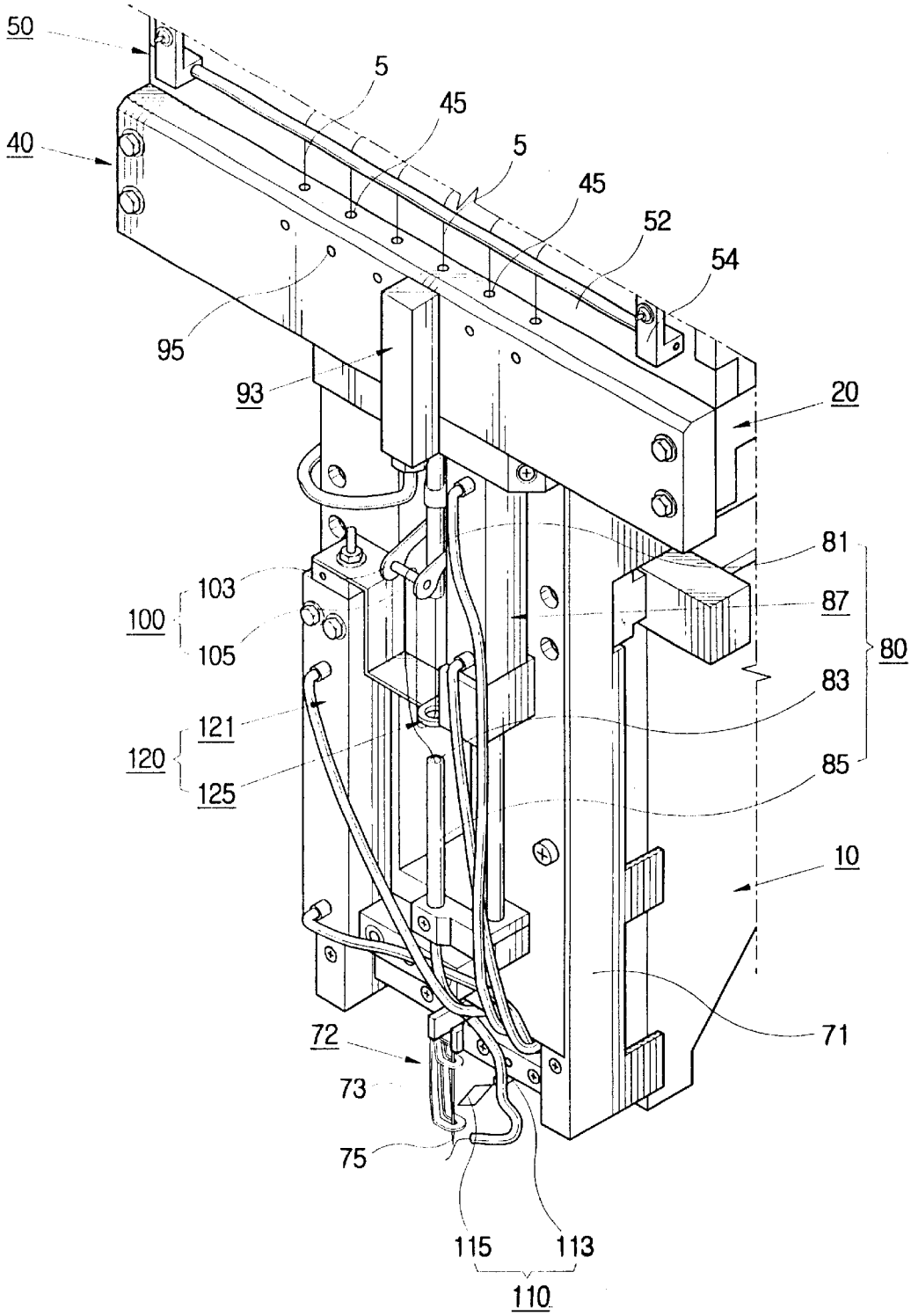
FIG. 3 is an enlarged perspective view partially showing a head assembly of FIG. 1.
Figure 4:
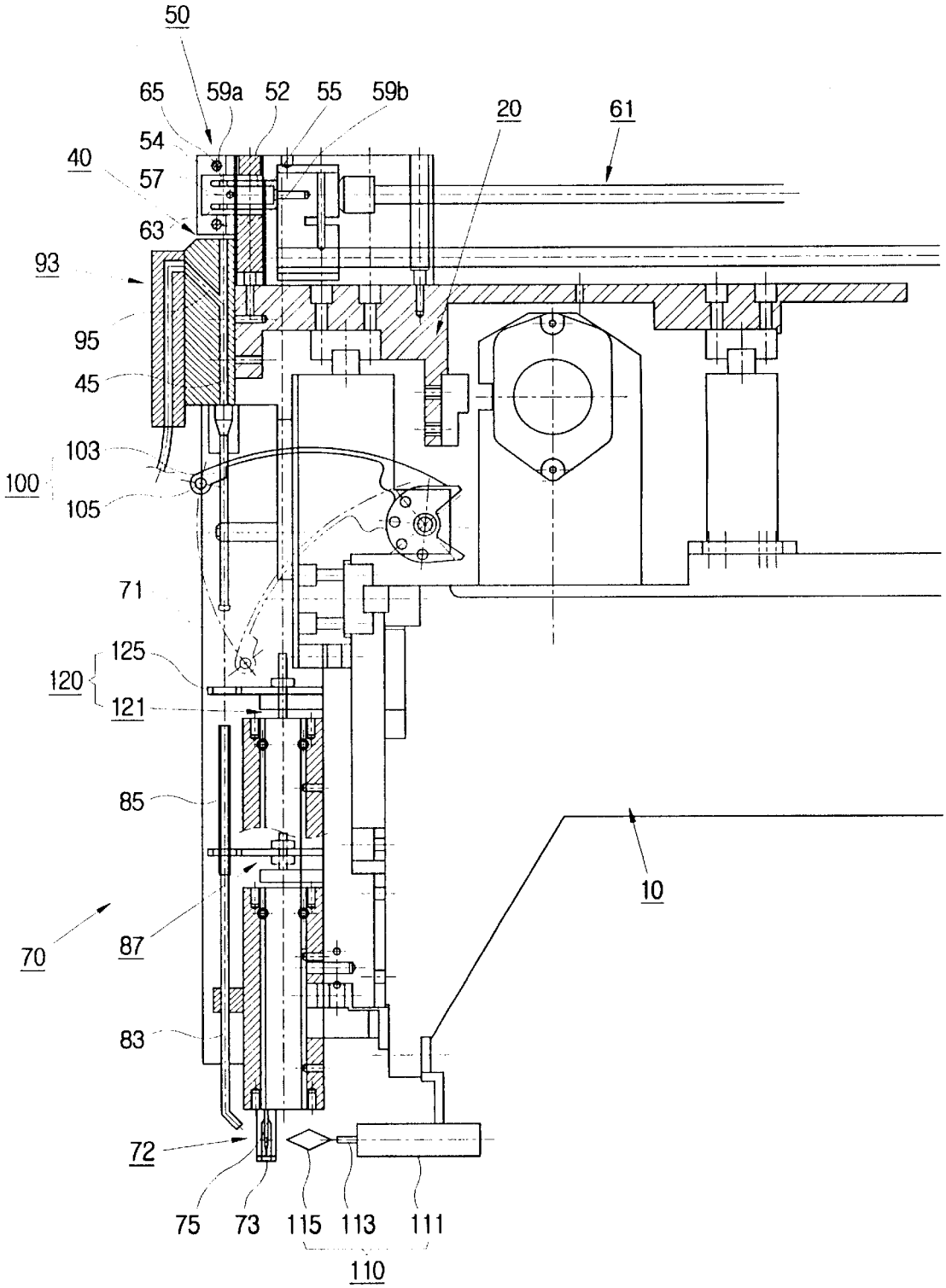
FIG. 4 is a side sectional view of the thread feeding apparatus of FIG. 1.

As illustrated in FIGS. 1 through 4, a thread feeding apparatus for an automatic embroidering machine ccording to the present invention includes a main frame 10, and a movable frame 20 supported by the main frame 10 and movably installed so as to slide reciprocally, i.e., leftward and rightward, along a guide rail 4. Between the main frame 10 and the movable frame 20 is provided a sliding driver (not shown) for sliding the movable frame 20 horizontally. The movable frame 20 is comprised of a thread supplying unit 30. The main frame 10 is comprised of a head assembly 70 having a needle-working unit 72 at its lower portion.

The thread supplying unit 30 installed on the movable frame 20 is comprised of a thread tension controller 8 for controlling a tension of each thread supplied from a plurality of bobbins (not shown), a thread positioning block 40 for positioning an end part of the thread having passed through the thread tension controller 8 to be on standby thereon, a thread tension adjusting unit 50 installed between the thread tension controller 8 arid the thread positioning block 40 for adjusting the positioning of the thread 5 to be on standby on the thread positioning block 40, and a thread transfer nozzle 93 for transferring the thread 5 positioned in the thread positioning block 40.

The thread positioning block 40 is coupled to a front part of the movable frame 20. In the thread positioning block 40 are arranged a plurality of thread passages 45 along the transverse direction thereof, passing through the thread positioning block 40 in the vertical direction. Ends of the threads supplied from the thread bobbins (not shown) are received and positioned in the thread passage 45, respectively. When the movable frame 20 slides relative to the main frame 10, the thread positioning block 40 moves horizontally, to thereby allow a selected one among the thread passages 45 to be aligned axially with a first thread guide pipe 81 to be described later. In the thread positioning block 40 are formed a plurality of air holes 95 communicating with the respective thread passages 45, the air holes 95 being downwardly inclined from a front part of the thread positioning block 40 toward the thread passages 45.

In the present embodiment, the thread passages 45 are arranged linearly. However, they may be arranged in an arc-shaped manner. In this case, the movable frame 20 is rotated relative to the main frame 10, to align a selected one among the thread passages 45 with the first thread guide pipe 81.

A thread positioning block having a plurality of thread passages which is disclosed in the Japanese First Publication or Laid-Open No. 6-254277, takes the shape of funnel and has a single thread passage at the lower part thereof. In this shape of positioning block, threads can be selectively transferred in the state that the thread supplying unit is fixed without sliding, thereby allowing the threads transferred from the thread passage to be guided into a first thread guide pipe.

The tension adjusting unit 50 includes a thread holding unit 52 disposed above the thread positioning block 40, and a plurality of tension adjusting bar 61 installed in the rear of the thread holding unit 52.

In the thread holding unit 52 are formed a plurality of thread distributing holes 55 corresponding to the thread passages 45. In the front part of the thread holding unit 52, a first tension bar 57 is installed so as to horizontally cross the middle of the thread distributing holes 55. In front of the thread holding unit 52 is disposed a thread holder 54 having a pair of second tension bars 59a and 59b and contacting with and separating from the upper edge and the lower edge of the thread distributing holes 55. In the rear of the thread holding unit 52 is installed a thread holder driver (not shown) allowing the thread holder 54 to contact with or separate from the upper edge and the lower edge of the thread distributing holes 55. A hydraulic cylinder, a pneumatic cylinder or a solenoid may be used as the thread holder driver (not shown).

The tension adjusting bars 61 are movably installed so as to reciprocate toward the thread holding unit 52. Thread suspension holders 63 are installed in the leading edges of the respective tension adjusting bars 61, for passing through the respective thread distributing holes 55 when the bars 61 move forward.

The thread suspension holder 63 is provided in a pair so that the upper and lower parts of the holder 63 are disposed above and below the first tension bar 57 when passing through the thread distributing hole 55. In the leading edge of each thread suspension holder 63 is formed a thread passing hole 65, allowing the thread to pass therethrough.

A thread transfer nozzle 93 is coupled with an upper part of the head stem 71 of the head assembly 70, so as to supply air from an air supply unit(not shown) into the air holes 95 of the thread positioning block 40. The thread transfer nozzle 93 is selectively communicated with any one of the plurality of air holes 95 by reciprocation of the thread supplying unit 30, and the air from the thread transfer nozzle 93 is blown into the thread passages 45 on the same axial line with the first thread guide pipe 81 through the respective air holes 95. Thus, the end of the thread within the thread passage 45 is transferred toward the needle-working unit 72 through a thread guide pipe assembly 80 (to be described later).

The head assembly 70 is comprised of the head stem 71 provided in front of the main frame 10, the needle-working unit 72 installed below the head stem 71, and the guide pipe assembly 80 forming a single thread transferring path, allowing the thread 5 within the thread passage 45 to be transferred to the needle-working unit 72. The head assembly 70 is further comprised of a needle threading unit 110 allowing the end of the thread transferred adjacent to the needle-working unit 72 to be bound into the eye of the needle 75 provided in the needle-working unit 72, and a thread taking-up unit 1.00 straining or loosening the thread 5 by taking up a part of the thread 5 passing through the thread guide pipe assembly 80.

The head stem 71 is approximate to a rectangular frame in shape. The needle-working unit 72 is comprised of the needle 75 provided at a lower part of the head stem so as to be moved vertically for a needlework, and a presser foot 73 pressing a web upon which the embroidery is made, along a travelling movement of the needle 75 during embroidery.

The thread guide pipe assembly 80 is comprised of the first thread guide pipe 81 disposed in the upper part of the head stem 71, a second thread guide pipe 83 disposed in the lower part of the head stem 71 on the same axial line with the first thread guide pipe 81 paced from the first guide pipe 81, an auxiliary guide pipe 85 opening and closing a space formed between the first thread guide pipe 81 and the second thread guide pipe 83, depending upon rise and fall of the auxiliary guide pipe 85, and a driver 87 for rising or falling the auxiliary guide pipe 85.

The first thread guide pipe 81 is disposed in the vertical direction so as to allow the thread 5 within the thread passage 45 to be smoothly received therein; and the second thread guide pipe 83 is extended in its lower part so as to be adjacent to the needle 75. The auxiliary guide pipe 85 has comparatively a bigger diameter than the second thread guide pipe 83 and is disposed coaxially around the second thread guide pipe 83. The auxiliary guide pipe driver 87 is provided as an air cylinder installed on one side of the head stem 71. A solenoid or a hydraulic cylinder may be used as the driver 87.

Desirably, the upper part of the first thread guide pipe 81 is widened in diameter so as to allow the thread 5 transferred downward from the thread passage 45 to be easily received therein. Further, it is effective that the lower part of the first thread guide pipe 81 is inserted into the upper part of the auxiliary guide pipe 85 so that the thread 5 in the first thread guide pipe 81 can be smoothly transferred toward the second thread guide pipe 83.

To open and close the space formed between the first thread guide pipe 81 and the second thread guide pipe 83, the auxiliary guide pipe 85 may be disposed coaxially around the first thread guide pipe 81.

Figure 9:
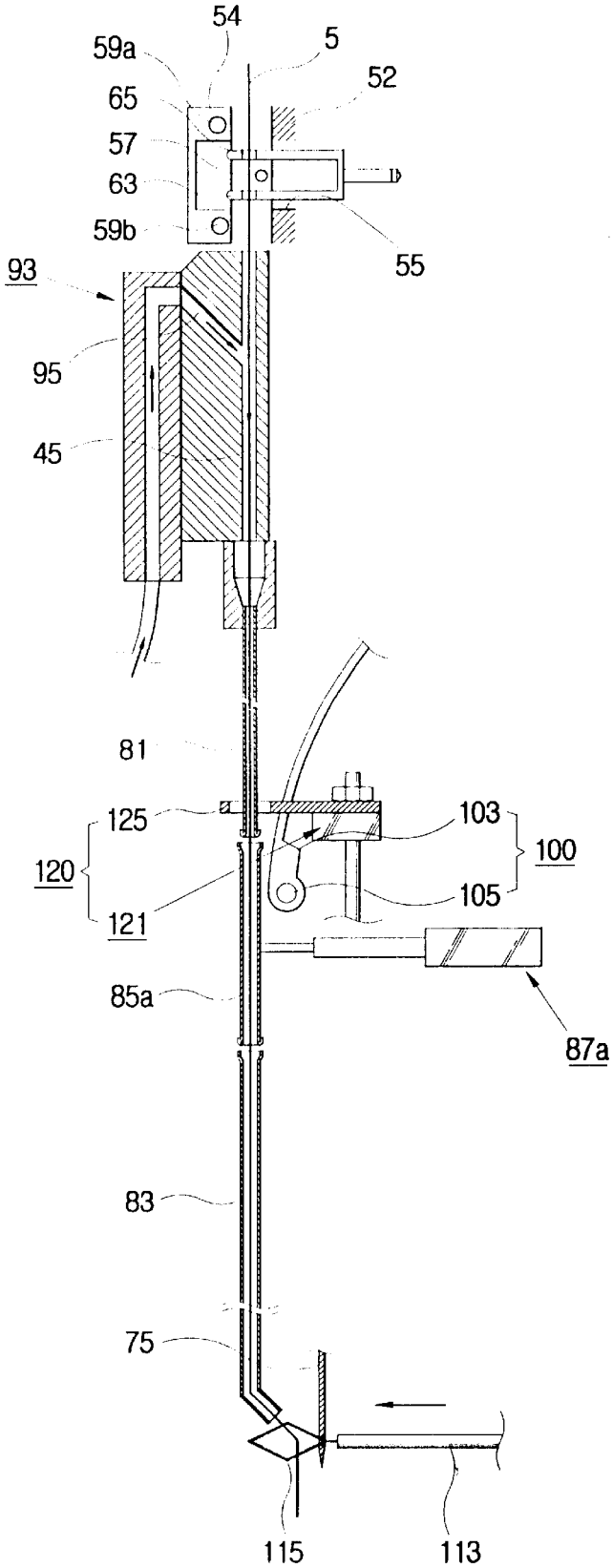
FIGS. 9 and 10 are side sectional views of a thread feeding apparatus for an automatic embroidering machine according to a second embodiment of the present invention.
Figure 10:
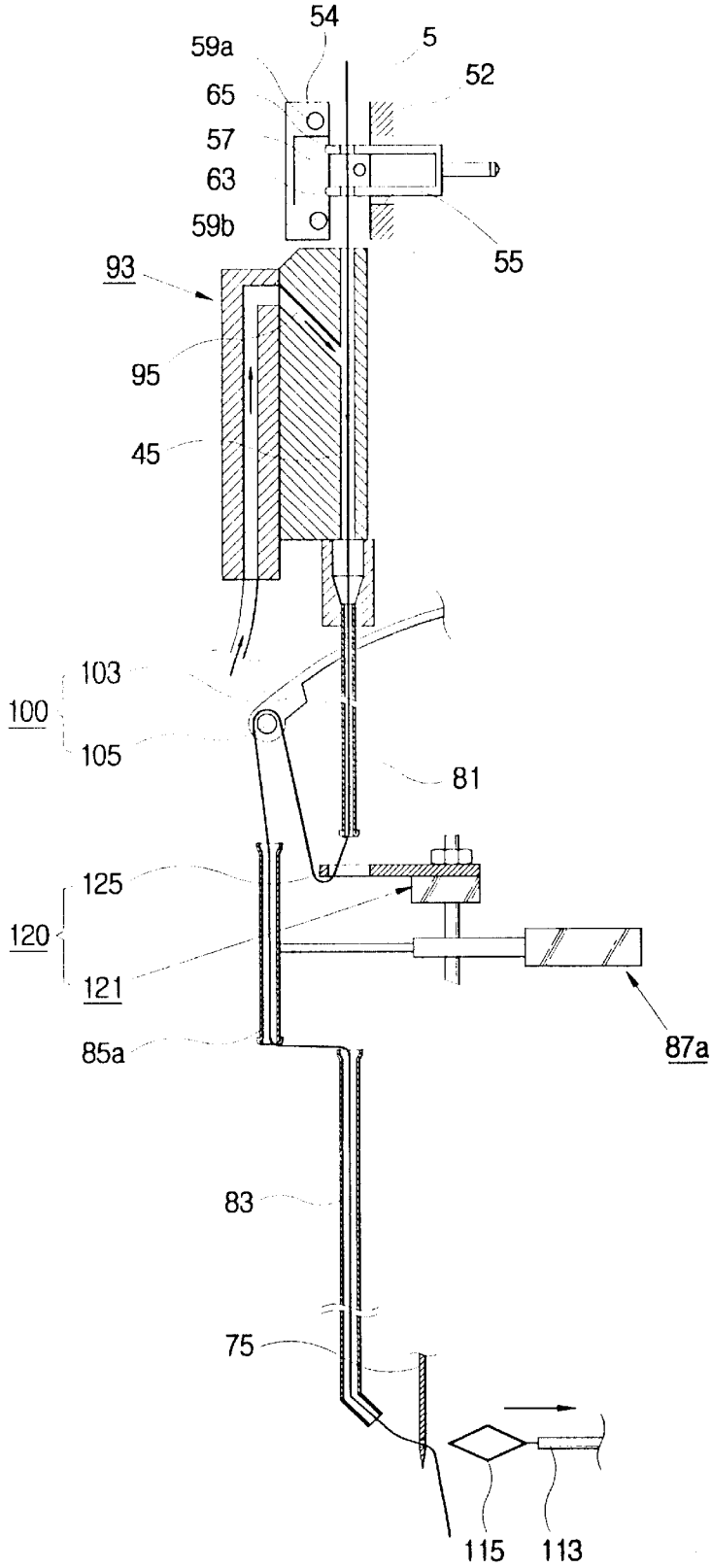

As shown in FIGS. 9 and 10, the space formed between the first thread guide pipe 81 and the second thread guide pipe 83 may be opened and closed by disposing an auxiliary guide pipe 85*a* transversely relative to the axial direction of the first thread guide pipe 81 and the second thread guide pipe 83. A hydraulic cylinder, a pneumatic cylinder or a solenoid, which moves reciprocally may be used as an auxiliary guide pipe driver 87*a*.

Figure 11:
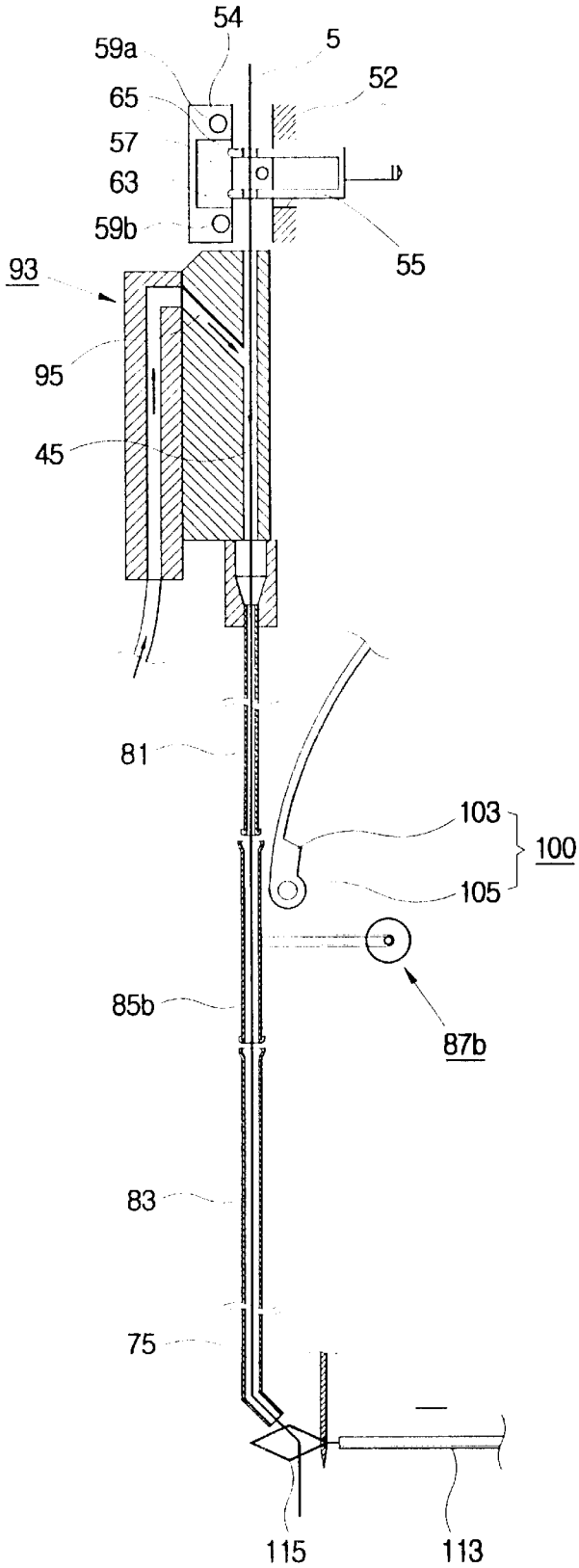
FIGS. 11 and 12 are side sectional views of a thread feeding apparatus for an automatic embroidering machine according to a third embodiment of the present invention.
Figure 12:
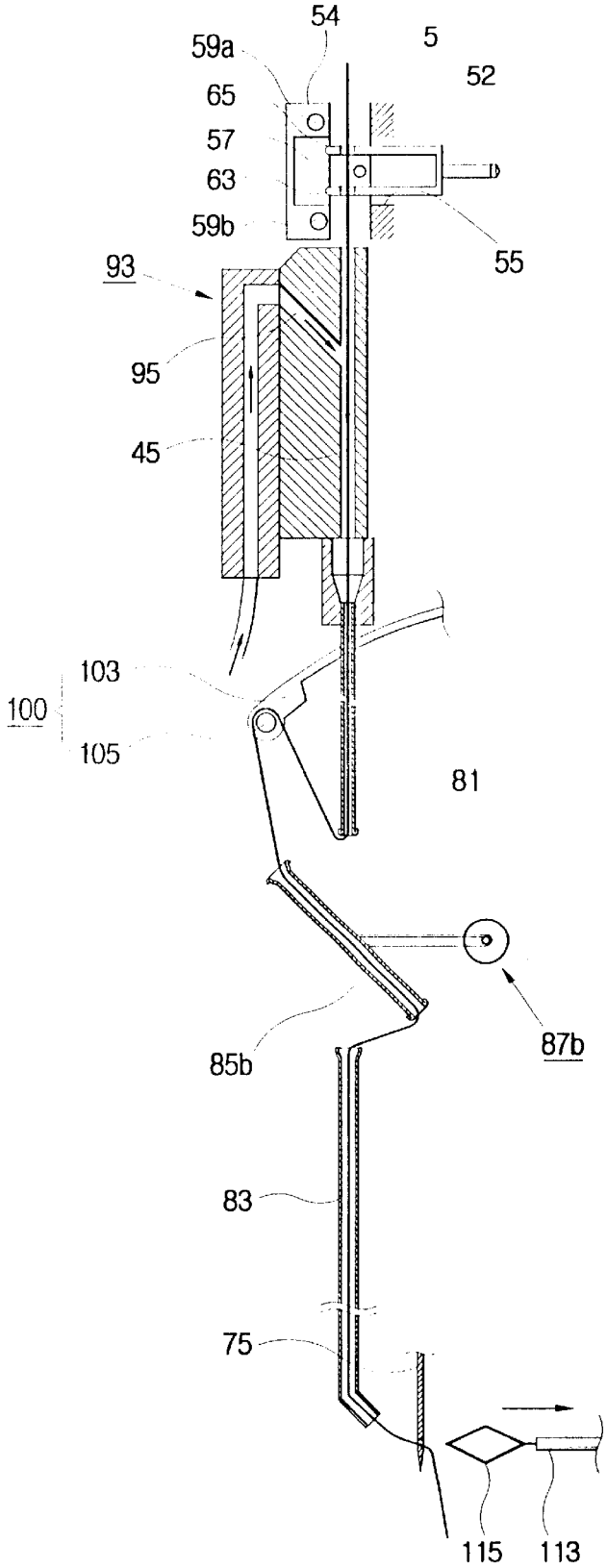

As shown in FIGS. 11 and 12, the space formed between the first thread guide pipe 81 and the second thread guide pipe 83 may be opened and closed by disposing an auxiliary guide pipe 85*b* rotatably in the space formed between the first thread guide pipe 81 and the second thread guide pipe 83, and providing a rotating driver 87*b* rotating the auxiliary guide pipe 85 reciprocally.

Figure 13:
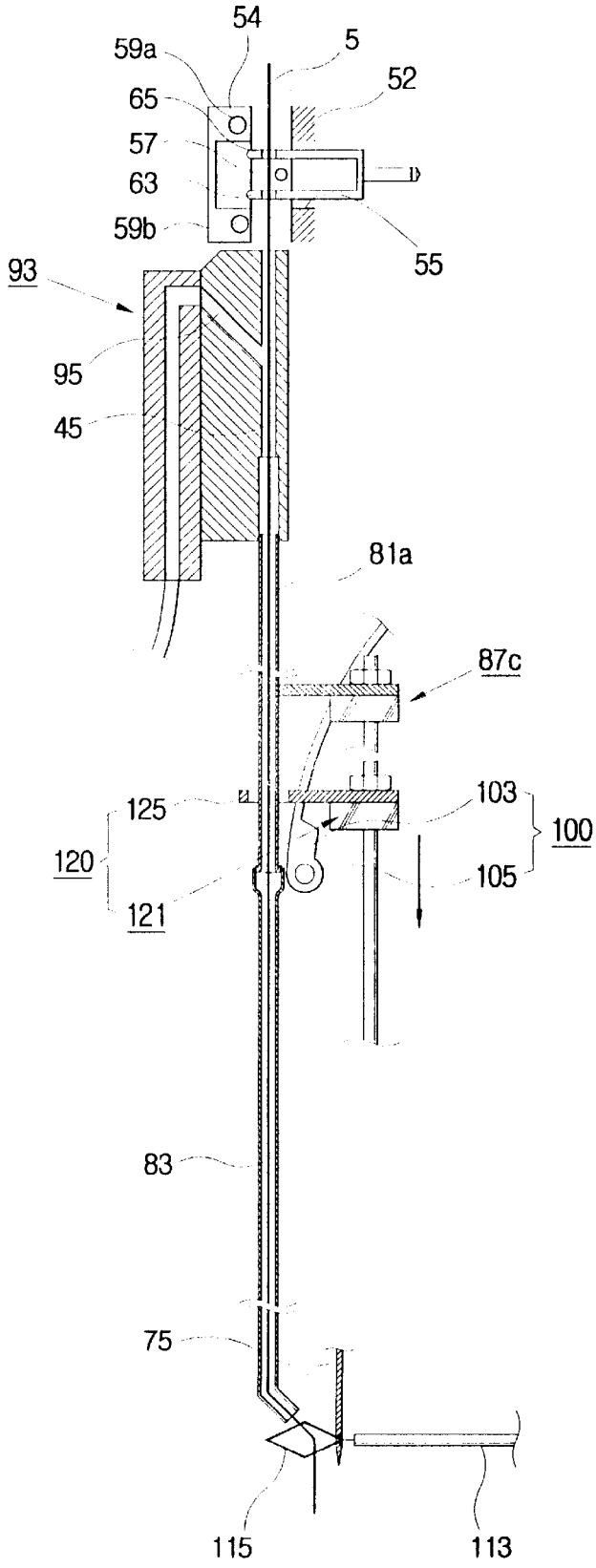
FIGS. 13 and 14 are side sectional views of a thread feeding apparatus for an automatic embroidering machine according to a fourth embodiment of the present invention.
Figure 14:
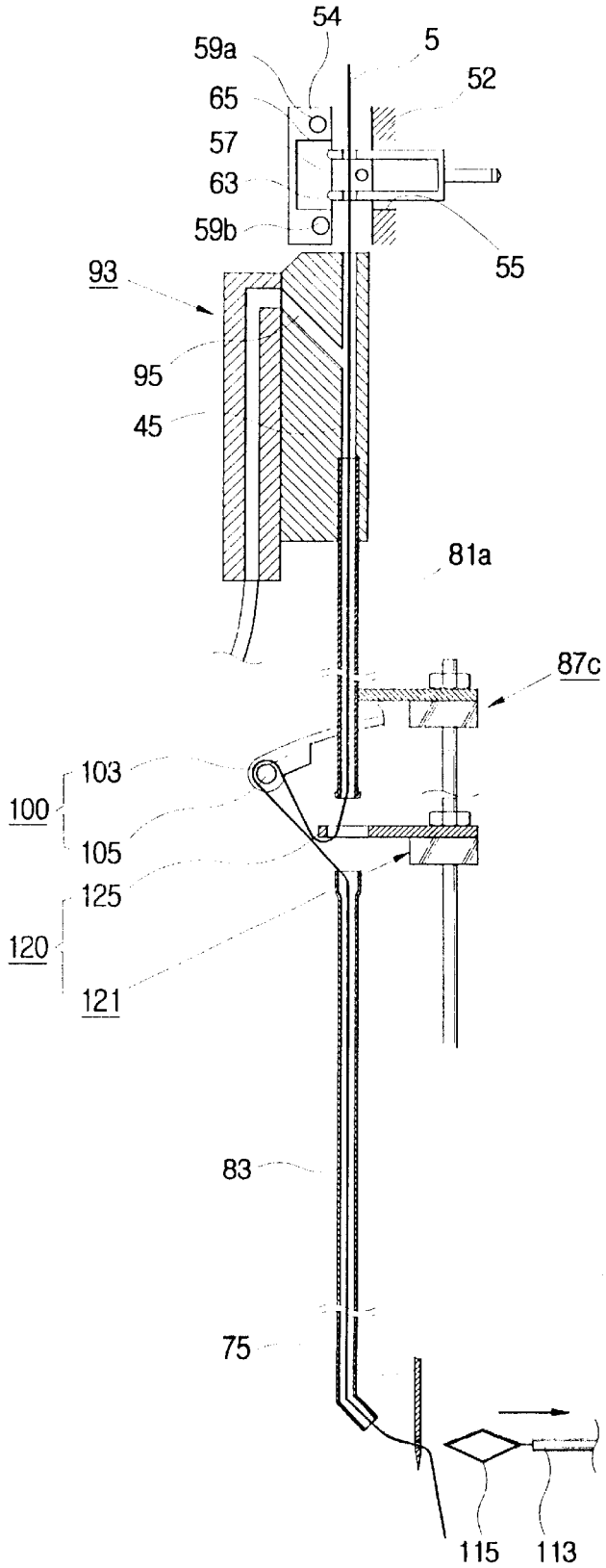

As shown in FIGS. 13 and 14, the space formed between a first thread guide pipe 81*a* and the second thread guide pipe 83 may be opened and closed by rising and falling the first thread guide pipe 81*a* to be contacted with and spaced from the second thread guide pipe 83, without providing an auxiliary guide pipe 83. The upper part of the first thread guide pipe 81*a* is inserted into the thread passage 45 and the upper part thereof is spaced from the upper part of the second thread guide pipe 83 when the first thread guide pipe 81*a* is elevated by an elevating driver 87*c*. When the first thread pipe 81*a* moves downward for supply of the thread 5, the upper part of the first thread guide pipe 81*a* is inserted into the lower part of the thread passage 45 to a predetermined depth and the lower part thereof is inserted into the upper part of the second thread guide pipe to a determined depth. When the thread supplying unit 30 slides, the upper part of the first thread guide pipe 81*a* is disengaged from the lower part of the thread passage 45 and the lower part thereof is inserted into the upper part of the second thread guide pipe 83.

In the embodiments described above, the first and second thread guide pipes 81 and 83 form a linear thread supplying path in the vertical direction; however, they may have a partially curved section except the section of the auxiliary guide pipe 85. It is desirable that the first thread guide pipe, the second thread guide pipe and the auxiliary guide pipe have respectively rounded edges in order to prevent the thread from cutting when the thread taking-up unit to be described later is operated.

In the embodiments described above, the space on the thread transferring path is opened or closed by elevating either of the auxiliary guide pipe or the first thread guide pipe, so that a take-up bar (to be described later) of the thread taking-up unit can pass through the space. However, the space on the thread transferring path can be minimized to the extent that the thread does not deviate therefrom, and the take-up bar of the thread taking-up unit can be as thin as possible to the extent that it can pass through the minimized space; with this configuration, the object of the present invention may be achieved without the auxiliary guide pipe, the elevating driver for elevating the auxiliary guide pipe, and any other components for elevating the first thread guide pipe.

The needle threading unit 110 is comprised of a loop transfer means 111 provided in the lower part of the head stem 71 adjacent to the needle-working unit 72, a loop transfer bar 113 forwarding toward or regressing from an eye of the needle 75 by the loop transfer means 111, and an elastic loop 115 coupled to the leading edge of the loop transfer bar 113, approximately taking the shape of a rhombus.

The loop 115 elastically passes through the eye of the needle 75 when the loop transfer bar 113 advances toward the needle 75, to be positioned in the lower part of the second thread guide pipe 83 and then receives the end of the thread transferred from the thread guide pipe. The loop 115 elastically regresses through the eye of the needle 75 when the loop transfer bar 113 regresses from the needle 75, to bind the end of the thread into the eye of the needle 75. A hydraulic cylinder, a pneumatic cylinder or a solenoid may be used as the loop transfer means 111.

The thread taking-up unit 100 is comprised of a take-up lever 103 rotatably moving across the transferring path of the thread 5, the take-up bar 105 combined with the take-up lever 103, for straining and loosening the thread 5 by reciprocating through the space between the first thread guide pipe 81 and the second thread guide pipe 83, and a lever driver (not shown) driving the take-up lever 103.

The take-up lever 103 is provided in a pair parallel with each other, between which the first thread guide pipe 81 is positioned, and the take-up bar 105 connects free ends of the take-up levers 103. The take-up lever 103 is rotated up and down by the lever driver (not shown), and accordingly the take-up bar 105 is rotated up and down through the space formed between the first thread guide pipe 81 and the second thread guide pipe 83, allowing the thread 5 to be strained and loosened.

The take-up lever 103 of the thread taking-up unit 100 may be installed so as to reciprocally move toward the front lower part of the guide pipe assembly 80 from the rear upper part of the guide pipe assembly 80, or it may be installed so as to forwardly and backwardly move toward the front part of the guide pipe assembly 80 from the rear part thereof.

The lever driver (not shown) may be provided as a motor or a cam device, etc. to operate the take-up lever 103, or as a hydraulic cylinder, a pneumatic cylinder or a solenoid, etc. to reciprocate the take-up lever 103.

In the above-described embodiment, the take-up lever 103 is provided in a pair; however, it can be provided in a single element. The take-up bar 105 may be combined with the take-up lever 103 in the form of a cantilever; however, it may be desirable to form it in the shape of "L," so that the thread 5 maintains in position.

An auxiliary threading unit 120 is preferably provided in the head assembly 70, for straining the thread 5 below the take-up bar 105 when the thread taking-up unit 100 reciprocates up and down.

The auxiliary threading unit 120 is comprised of a threading ring installed so as to move up and down coaxially relative to the first thread guide pipe 81, and a ring driver 121 elevating the threading ring 125. The threading ring 125 is elevated upward before the thread 5 is transferred to the thread guide pipe assembly 80, and then positioned coaxially relative to the first guide pipe assembly 81. After the thread 5 is transferred downward through the guide pipe assembly 80, if the thread 5 in the space between the first and second thread guide pipes 81 and 83 is taken up by the thread taking-up unit 100, the threading ring 125 moves downward to take up and down the thread portion between the lower part of the first thread guide pipe 81 and the take-up bar 105 of the thread taking-up unit 100. Thus, the thread 5 is strained below the take-up bar 105. The ring elevating driver 121 elevating the threading ring 125 may be provided as a hydraulic cylinder, a pneumatic cylinder or a solenoid.

With this configuration, to make embroidery by operating the thread feeding apparatus for an automatic embroidering machine according to the present invention, the tension adjusting bar 61 is first moved forward, allowing the respective leading edges of the thread suspension holders 63 to be protruded toward the front parts of the plurality of thread distributing holes 55 and the first tension bar 57.

Then, different colors of threads 5 supplied from the plurality of bobbins (not shown) are respectively bound to the thread tension controllers 8, and the ends of the respective threads 5 pass through between the upper second tension bar 59*a* and the thread holding unit 52 and are inserted into the thread passing holes 65 of the thread suspension holders 63. Then, the ends of the respective threads 5 pass through between the lower second tension bar 59*b* and the thread holding unit 52 and are positioned into the plurality of thread passages 45 formed in the thread supplying unit 30.

Figure 5:
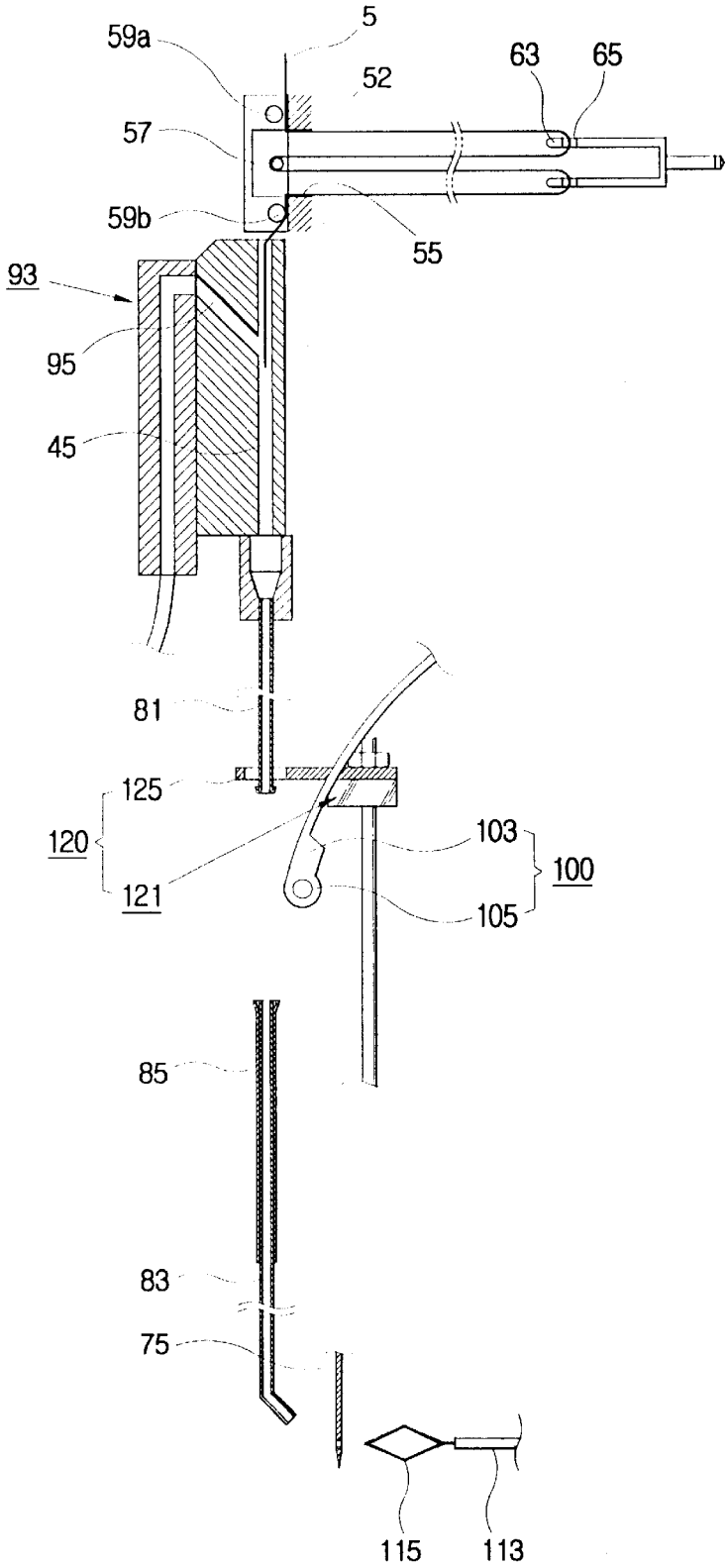
FIGS. 5 to 8 are enlarged side sectional views for sequentially describing the operation processes of the thread feeding apparatus in FIG. 1.

The thread adjusting bar 61 is retreated backward and the upper second tension bar 59*a* of the thread holder 54 maintains a predetermined space relative to the thread holding unit 52 so that the thread 5 is strained backward. The lower second tension bar 59*b* of the thread holding unit 54 contacts the thread holding unit 52, with pressing the thread 5, so that the thread 5 is not strained backward. Thus, the end of each thread 5 is, as shown in FIG. 5, is positioned in each thread passage 45.

When the threads 5 are on standby in the respective thread passages 45, an external power is supplied to operate the apparatus. The controlling unit (not shown) then moves the movable frame 20 horizontally, so as to position a thread passage selected from the plurality of thread passages 45 with the first thread guide pipe 81. An air hole 95 corresponding to the selected thread passage 45 positioned in communication with the first thread guide pipe 81 is positioned to communicate with the thread transfer nozzle 93.

Figure 6:
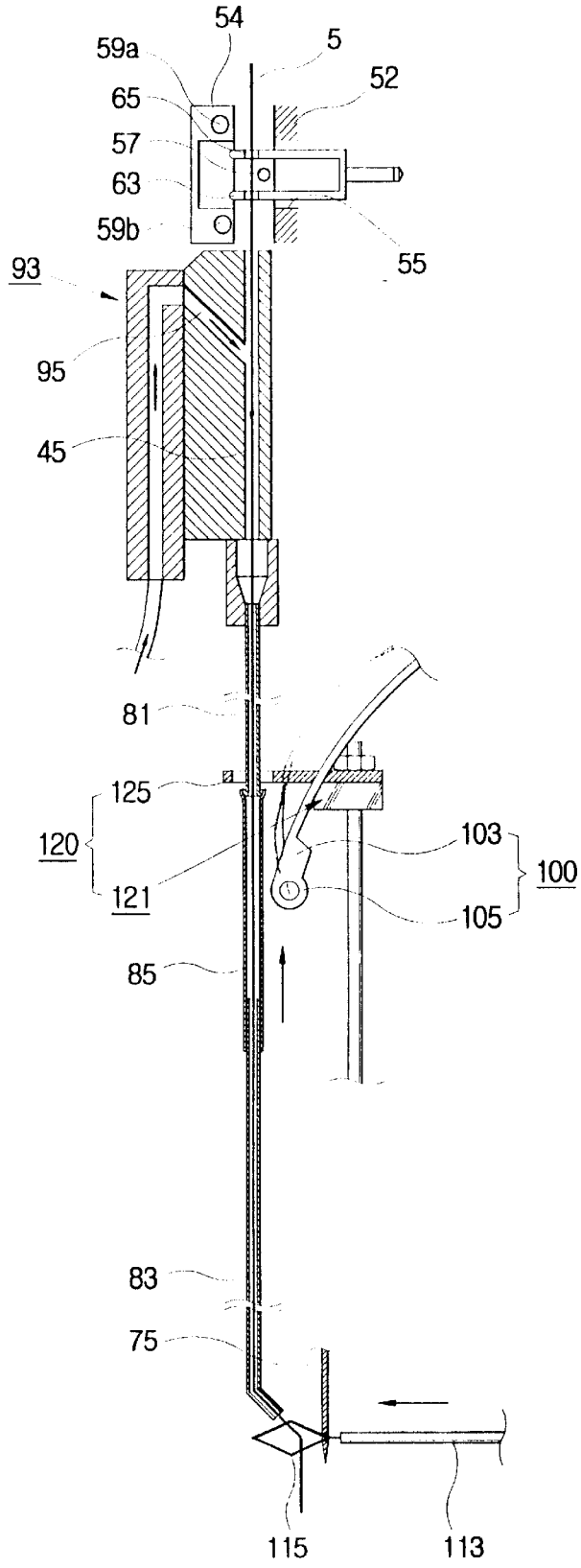

The controlling unit, as depicted in FIG. 6, elevates the auxiliary guide pipe 85 to be connected with the first and second thread guide pipes 81 and 83, and in the meantime, advances the loop transfer bar 112 of the needle threading unit 110 so that the loop 115 passes through the eye of the needle 75 and is on standby below the second thread guide pipe 83. The tension adjusting bar 61 corresponding with the selected thread passage 45 is advanced to be partially inserted into the thread distributing hole 55 of the thread suspension holder 63, thereby loosening the thread 5 being on standby and blowing air into the thread transfer nozzle 93 at the same time.

The blown air is supplied into the thread passage 45 through the air hole 95, and the thread 5 on standby in the thread passages 45 is transferred downward. The downward transferred thread 5 passes through the first thread guide pipe 81, the auxiliary guide pipe 85 and the second thread guide pipe 83 in sequence, and is received in the loop 115 on standby below the second thread guide pipe 83.

The take-up bar 105 of the thread taking-up unit 100 is on standby in the rear portion of the auxiliary guide pipe 85, and the threading ring 125 is positioned in the lower end portion of the first thread guide pipe 81 above the auxiliary guide pipe 85.

Figure 7:
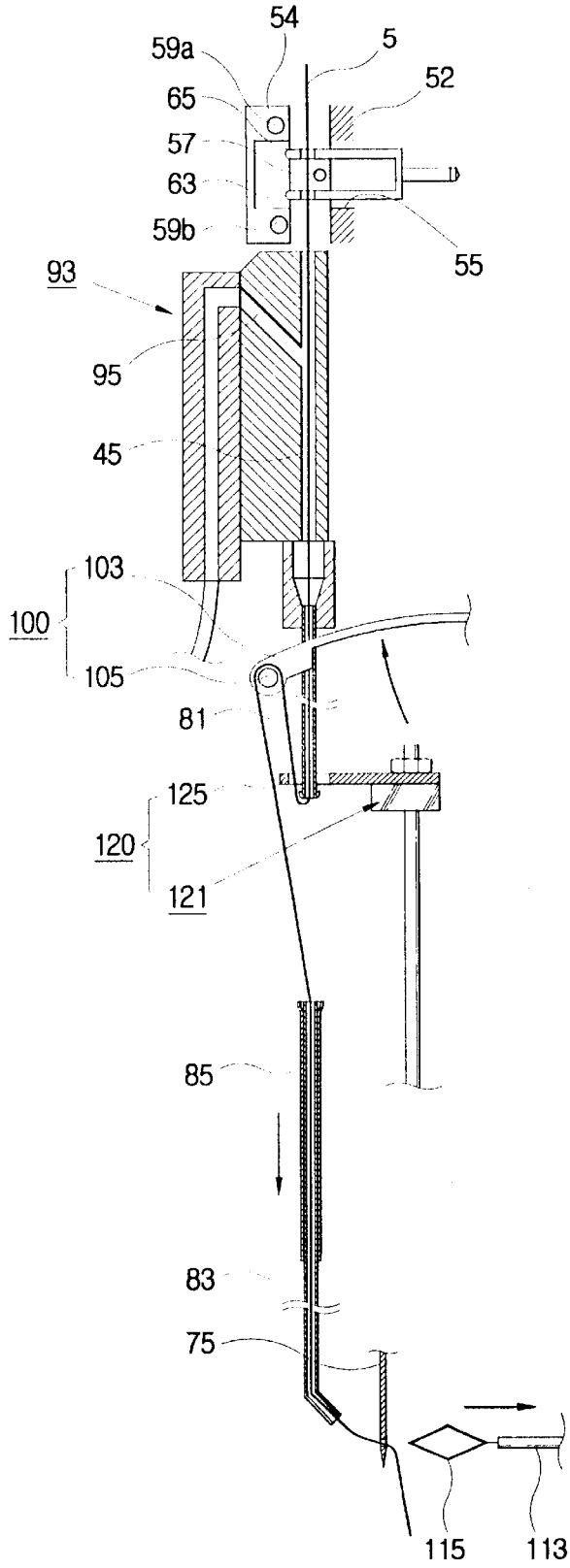

After the thread 5 is transferred to be received in the loop 115, the controlling unit (not shown), as illustrated in FIG. 7, retreats the loop transfer bar 113 so that the loop 115 is retreated through the eye of the needle 75, allowing the end of the thread 75 to be inserted into the eye of the needle 75.

After the end of the thread 5 is inserted into the eye of the needle 75, the controlling unit (not shown) moves the auxiliary guide pipe 85 downward, so that the first and second thread guide pipes 81 and 83 are disconnected from each other. Then, the take-up lever 103 of the thread taking-up unit 100 is pulled upward, and then the thread in the space between the first and second thread guide pipes 81 and 83 is taken up. Preferably, the lower end part of the first thread guide pipe 81 is rounded, in order to prevent the thread taken up by the thread taking-up unit 100 from being cut by contacting with the lower end part of the first thread guide pipe 81.

Figure 8:
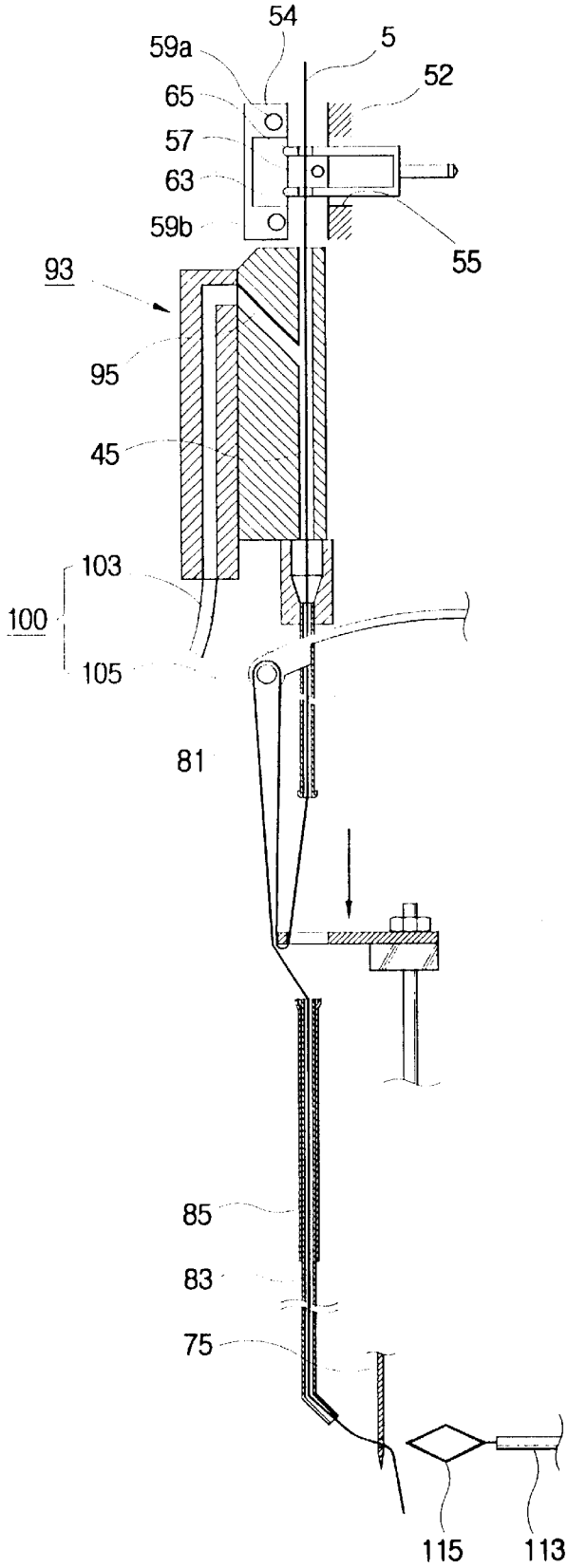

After the thread 5 is taken-up, the threading ring 125, as shown in FIG. 8, moves downward and the thread between the take-up bar 105 and the lower end part of the first thread guide pipe 81 is pulled down. Through these processes, the preparation for making embroidery is finished.

After then, the controlling unit operates the needle 75 and the presser foot 73 to perform the needlework. The thread taking-up unit strains and loosens the thread 5 by moving vertically and reciprocally in response to operation of the needle 75. Thus, the work of embroidery is smoothly performed.

Where the thread 5 is cut during the work of embroidery, the controlling unit detects cutting of the thread 5 and retreats the tension adjusting bar 61 backward. The thread suspension holders 63 coupled with the front end of the tension adjusting bar 61 pulls up the end of the cut thread 5, and the end of the pulled up thread 5 returns to the thread passage 45 through the second and first thread guide pipes.

When the end of the pulled up thread 5 returns to the thread passage 45 through the second and first thread guide pipes and is on standby therein, the controlling unit repeats the processes of feeding the thread, as described above, and subsequently performs the work of embroidery.

When embroidery is finished with the thread 5 of a desired color and a user wishes to continue the work of embroidery with a different color of thread 5, the controlling unit first cuts the finished thread 5 with a thread cutter (not shown). The tension adjusting bar 61 is retreated backward and the thread 5 returns to the thread passage 45. Then, the controlling unit moves the thread supplying unit 30 horizontally so that the thread passage 45 in which a thread of the different color for the next embroidery is on standby can align with the upper end of the first thread guide pipes 81.

As mentioned above, the controlling unit performs the operation of thread feeding and continues the work of embroidery.

Through these processes, even where the thread is cut during the work of embroidery or changed to a different color of thread for the next embroidery, the thread does not remain on the thread transferring path and there is no need to stop the apparatus for the next work of embroidery, thereby improving the efficiency of needle-working.

Figure 15:
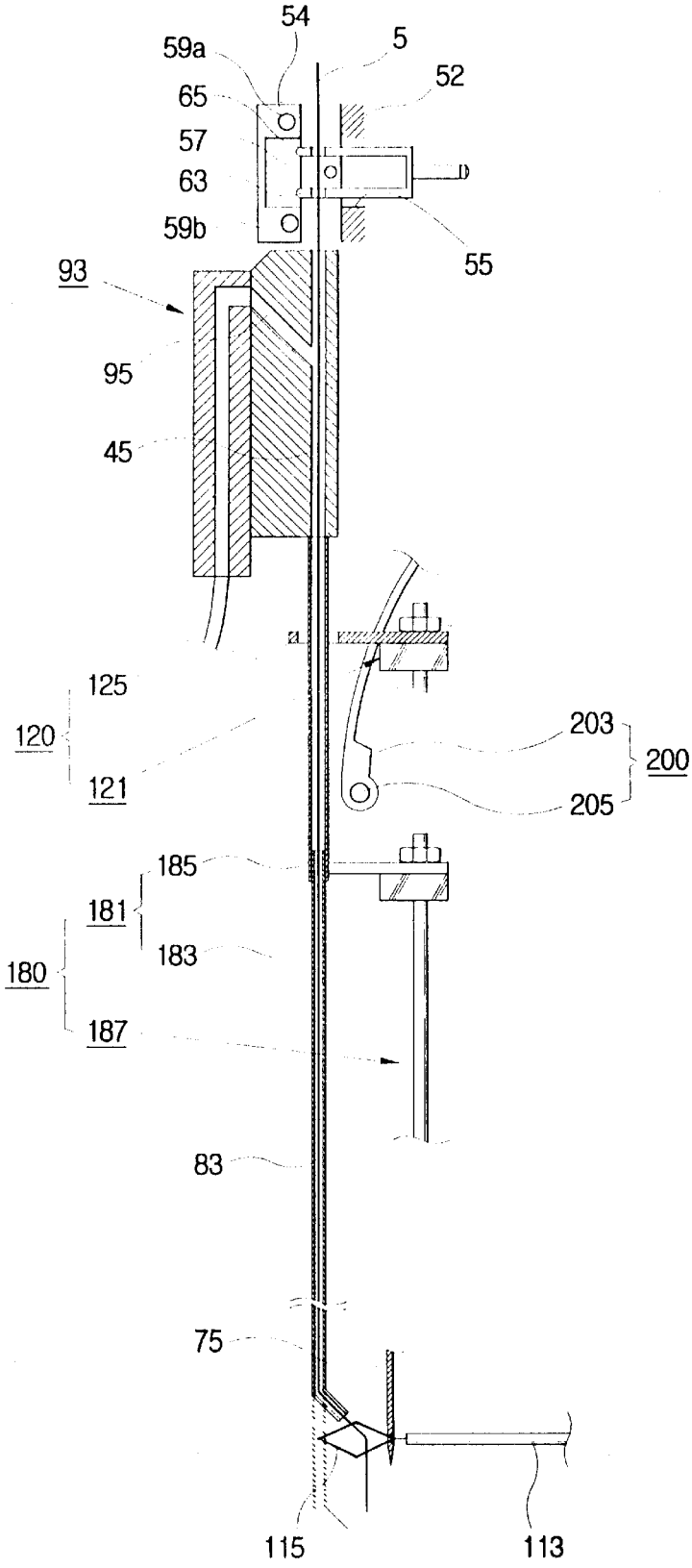
FIGS. 15 and 16 are side sectional views of a thread feeding apparatus for an automatic embroidering machine according to a fifth embodiment of the present invention.
Figure 16:
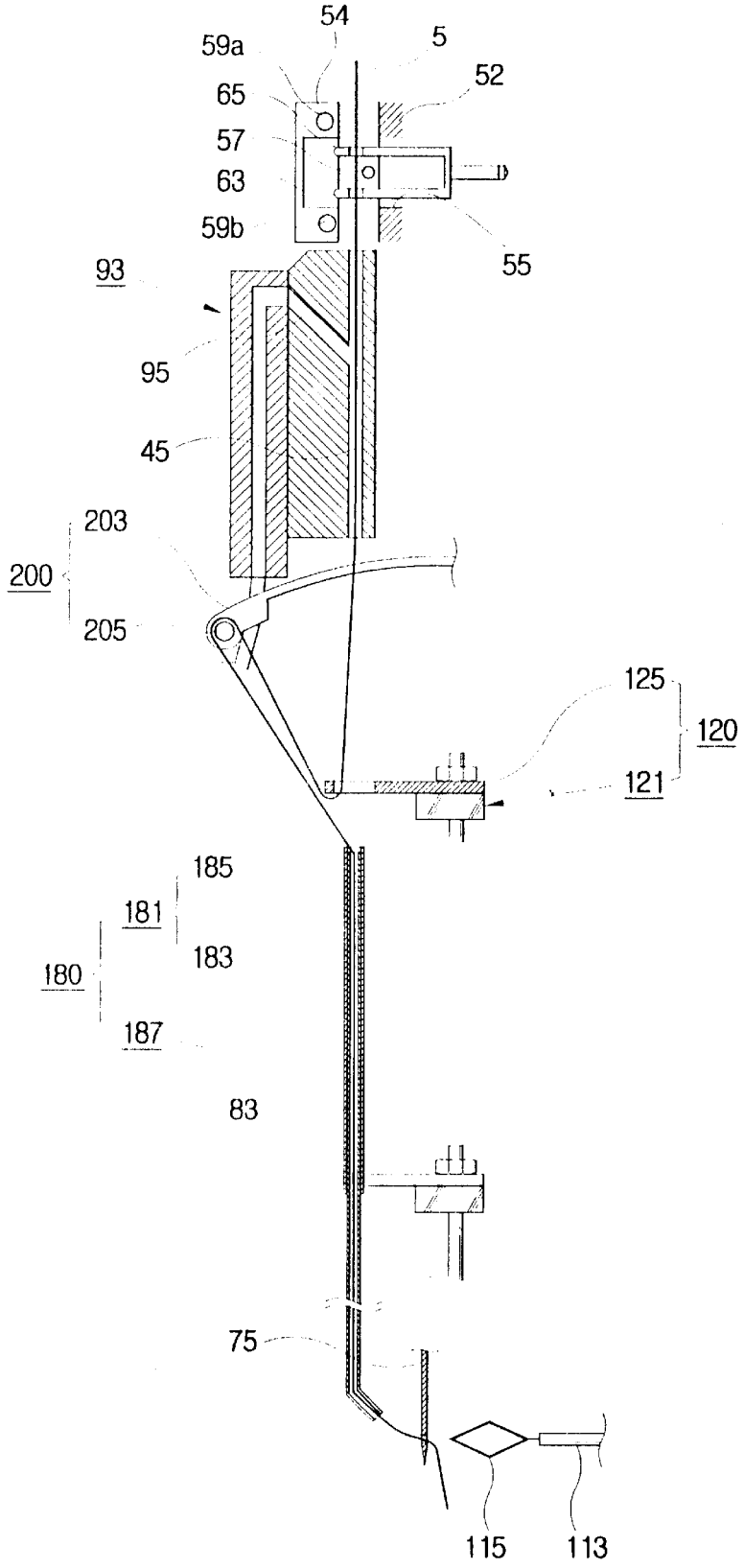

FIGS. 15 and 16 are side sectional views of a thread feeding apparatus for an automatic embroidering machine according to a fifth embodiment of the present invention. As depicted therein, the thread feeding apparatus has generally the same configuration as the above-described embodiments except for a guide pipe assembly and a thread taking-up unit, the description of the same elements therein will be omitted and only the guide pipe assembly and the thread taking-up unit will be described. The numerals and names indicating the same elements will be referred to in the same manner for the sake of convenience.

The guide pipe assembly 180 according to the present embodiment is comprised of a thread guide pipe 181 disposed vertically to the head stem 71 for receiving the thread 5 positioned in the thread passage 45 of the thread supplying unit 30, and a guide pipe driver 187 for elevating the thread guide pipe 181 to form a space between the thread passage 45 and the thread guide pipe 181.

The thread guide pipe 181 is comprised of a main thread guide pipe 183 whose lower end is extended to be adjacent to the needle-working unit 72 installed at the lower part of the head stem 71, and an auxiliary guide pipe 185 movably disposed coaxially in the upper end of the main thread guide pipe 183. The guide pipe driver 187 is installed at one side of the head stem 71 to elevate the auxiliary guide pipe 185.

The thread guide pipe 181 may be comprised of a single guide pipe without the auxiliary guide pipe 185. In this case, the space formed between the upper end of the thread guide pipe 181 and the thread passage 54 should have such a size that the lower end of the thread guide pipe 181 is not excessively isolated from the needle-working unit 72. With this, the end of the thread transferred through the lower end of the thread guide pipe 181 can be received in the loop 115 of the needle threading unit 110 in a stable manner.

The thread taking-up unit 200 according to the present embodiment is reciprocably installed toward the front lower of the thread guide pipe 181 from the rear upper thereof through the space formed between the upper end of the thread guide pipe 181 and the thread passage 45. The thread taking-up unit 200 is comprised of a take-up lever and a take-up bar 205 coupled to free end parts of the take-up levers 203, similar to the above-described take-up lever 103 and the take-up bar 105.

With this configuration, in the upper thread supplying unit for an automatic embroidery apparatus according to the present embodiment, the auxiliary guide pipe 185 is elevated upward, as seen in FIG. 15, to receive the thread 5 on standby in the thread passage 45.

When the end of the thread 5 is transferred adjacent to the needle-working unit 72 through the thread guide pipe 181, as depicted in FIG. 16, the auxiliary guide pipe 185 is elevated downward, and the space is formed between the upper end of the thread guide pipe 181 and the thread passage 45. The thread taking-up unit 200 strains and loosens the thread 5 by moving vertically and reciprocally through the space formed between the thread guide pipe 181 and the thread passage 45.

As described above, the thread feeding apparatus for an automatic embroidery machine according to the present invention can be operated with a single head stem, thereby being simplified in structure. Further, a curved passage can be removed from the whole thread transferring path, and therefore, the thread can be smoothly fed. Additionally, a space on the thread transferring path can be created or removed as necessary, thereby preventing the thread being supplied from deviating therefrom.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A thread feeding apparatus for an automatic embroidering machine, comprising:

a head stem having a needle-working unit;

a thread supplying unit supplying a colored thread selected among a plurality of threads;

a guide pipe assembly provided at said head stem, having a first guide pipe receiving the thread from said thread supplying unit, and a second guide pipe having an upper end spaced axially from said first guide pipe and a lower end adjacent to said needle-working unit; and a thread taking-up unit having a take-up lever moving up and down across a thread transferring path, and a take-up bar coupled with the take-up lever in a transverse direction relative to movement of the take-up bar, moving reciprocally through a space between said first and second guide pipes according to the movement of said take-up lever, to allow said thread to be strained or loosened.

2. The apparatus according to claim 1, wherein the thread supplying unit comprises:

a plurality of thread passages arranged in parallel above said head stem, horizontally relative to an axial direction of said first guide pipe, within which the end parts of said threads are respectively positioned;

a tension adjusting unit adjusting a tension status of said threads; and a thread transfer nozzle transferring said end parts of the threads through said first and second guide pipes by blowing air into said thread passages.

3. The apparatus according to claim 2, further comprising:

a main frame supporting said head stem;

a movable frame installed to said main frame to support said thread supplying unit, being slidable above said main frame so that one thread passage among said thread passages aligns with said first guide pipe; and a sliding driver for sliding said movable frame relative to said main frame.

4. The apparatus according to claim 2, wherein said thread supplying unit has a plurality of air holes penetrated thereinto, inclining downward toward said thread passages from outside; and wherein said thread transfer nozzle is coupled to an upper part of said head stem, blowing air into said air holes, through which the air is supplied into one thread passage selected by the movement of said movable frame.

5. The apparatus according to claim 1, wherein said guide pipe assembly comprises:

an auxiliary guide pipe coaxially installed to said first or second thread guide pipes; and an auxiliary guide pipe driver closing and opening said space between said first and second thread guide pipes by elevating said auxiliary guide pipe.

6. The apparatus according to claim 1, wherein said guide pipe assembly comprises:

an auxiliary guide pipe interposed between said first and second thread guide pipes; and an auxiliary guide pipe driver closing and opening said space between said first and second guide pipes by moving said auxiliary guide pipe transversely relative to the axial direction.

7. The apparatus according to claim 1, wherein said guide pipe assembly comprises:

an auxiliary guide pipe rotatably interposed within said space between said first and second guide pipes; and an auxiliary guide pipe driver closing and opening said space between said first and second guide pipes by moving said auxiliary guide pipe transversely relative to the axial direction.

8. The apparatus according to claim 1, wherein said guide pipe assembly comprises a guide elevating driver closing and opening said space between said first and second guide pipes by elevating said first or second guide pipes.

9. The apparatus according to claim 1, wherein said thread taking-up unit comprises a pair of said take-up levers arranged such that said first guide pipe is placed therebetween; and said take-up bar connecting free ends of said pair of take-up levers.

10. The apparatus according to claim 1, further comprising an auxiliary taking-up unit including:

a thread suspension ring elevatably installed coaxially relative to said first guide pipe; and a ring driver elevating said thread suspension ring, to have said thread strained below said take-up bar.

11. A thread feeding apparatus for an automatic embroidering machine, comprising:

a head stem having a needle-working unit;

a thread supplying unit supplying one thread selected among a plurality of threads;

a guide pipe assembly provided to said head stem, having a thread guide pipe receiving the thread from said thread supplying unit and having a lower end adjacent to said needle-working unit, and a guide pipe driver elevating said guide pipe so that a predetermined space is formed between said thread passage and said guide pipe;

a thread taking-up unit having a take-up lever moving up and down across a thread transferring path, and a take-up bar coupled with the take-up lever in a transverse direction relative to movement of the take-up bar, moving reciprocally through a space between said first and second guide pipes according to the movement of said take-up lever, to allow said thread to be strained or loosened.

12. The apparatus according to claim 11, wherein the thread supplying unit comprises:

a plurality of thread passages arranged in parallel above said head stem, horizontally relative to an axial direction of said guide pipe, within which the end parts of said threads are respectively positioned;

a tension adjusting unit adjusting a tension status of said threads and releasing them; and a thread transfer nozzle transferring said end parts of the threads through said guide pipe by blowing air into said thread passages.

13. The apparatus according to claim 11, further comprising:

a main frame supporting said head stem;

a movable frame installed to said main frame to support said thread supplying unit, being slidable above said main frame so that one thread passage among said thread passages aligns with said guide pipe; and a sliding driver for sliding said movable frame relative to said main frame.

14. The apparatus according to claim 11, wherein said thread supplying unit has a plurality of air holes penetrated thereinto, inclining downward toward said thread passages from outside; and wherein said thread transfer nozzle is coupled to an upper part of said head stem, blowing air into said air holes, through which the air is supplied into one thread passage selected by the movement of said movable frame.

15. The apparatus according to claim 11, wherein said guide pipe comprises a first guide pipe coupled to said head stem, having an upper end part isolated from said thread passages, and an auxiliary guide pipe installed coaxially over the first guide pipe; and wherein said guide pipe driver closes and opens said space between the thread passages and the first guide pipe by elevating said auxiliary guide pipe.

16. The apparatus according to claim 11, wherein said thread taking-up unit comprises a pair of said take-up levers arranged such that said first guide pipe is placed therebetween; and said take-up bar connecting free ends of said pair of take-up levers.

17. The apparatus according to claim 11, further comprising an auxiliary take-up unit including:

a thread suspension ring elevatably installed coaxially relative to said first guide pipe; and a ring driver elevating said thread suspension ring, to have said thread strained below said take-up bar.

* * * * *

UNITED STATES PATENT AND TRADEMARK OFFICE

CERTIFICATE OF CORRECTION

PATENT NO. : 6,325,006 B1
DATED : December 4, 2001
INVENTOR(S) : Ham-Kyu Park

It is certified that error appears in the above-identified patent and that said Letters Patent is hereby corrected as shown below:

Title page,
Add Item:
-- [30] Foreign Application Priority Data
August 17, 1999 (KR) Korea…….. 1999-16986 --.

Signed and Sealed this

Sixth Day of January, 2004

JAMES E. ROGAN
*Director of the United States Patent and Trademark Office*